United States Patent [19]

Takada et al.

[11] Patent Number: 4,564,145

[45] Date of Patent: Jan. 14, 1986

[54] ELECTROMAGNETIC FUEL INJECTOR

[75] Inventors: Shigetaka Takada, Obu; Toshiro Makimura, Nagoya; Mamoru Matsubara, Obu, all of Japan

[73] Assignee: Aisan Kogyo Kabushiki Kaisha, Aichi, Japan

[21] Appl. No.: 495,152

[22] Filed: May 17, 1983

[30] Foreign Application Priority Data

Aug. 4, 1982 [JP] Japan ..... 57-119438[U]
Nov. 1, 1982 [JP] Japan ..... 57-166868[U]

[51] Int. Cl.[4] ..... F02M 51/06
[52] U.S. Cl. ..... 239/585; 239/533.3
[58] Field of Search ..... 239/533.2–533.12, 239/589, 585

[56] References Cited

U.S. PATENT DOCUMENTS 4,106,702 8/1978 Gardner et al. ..... 239/533.3
4,394,974 7/1983 Saito ..... 239/585
4,403,741 9/1983 Moriya et al. ..... 239/585
4,417,694 11/1983 Claxton et al. ..... 239/533.12

FOREIGN PATENT DOCUMENTS 5543 1/1982 Japan ..... 239/585
2023228 12/1979 United Kingdom ..... 239/533.3

*Primary Examiner*—Andres Kashnikow
*Attorney, Agent, or Firm*—Dennison, Meserole, Pollack & Scheiner

[57] ABSTRACT

Disclosed herein is an electromagnetic fuel injector comprising a fuel outlet opening formed at the front portion of the slide member of the valve body, an annular fuel passage leading from the fuel outlet opening to the valve seat and an annular restricted portion provided at the annular fuel passage. The fuel injector of the invention may compensate decrease in the amount of fuel flow because of decrease in the specific weight of fuel and creation of fuel vapor at the fuel injection nozzle in association with increase in fuel temperature, and may supply an engine with fuel mixture having stable air-fuel ratio to purify exhaust gas during engine operation at high temperatures.

3 Claims, 16 Drawing Figures

ELECTROMAGNETIC FUEL INJECTOR

BACKGROUND OF THE INVENTION

This invention relates to an electromagnetic fuel injector for use in an electronically controlled fuel injection system of a single- or multiple-point type for an internal combustion engine in an automotive vehicle.

A valve structure of an electromagnetic fuel injector including a spherical valve member is well-known in the art. In such a valve structure, however, coefficient of viscosity of fuel has little contribution to determination of the amount of injected fuel flow. Thus, when fuel temperature is increased, the specific weight of fuel is decreased to thereby immediately influence the amount of fuel flow, that is, to disadvantageously decrease the amount of fuel.

SUMMARY OF THE INVENTION

Accordingly, it is an object of the present invention to provide an electromagnetic fuel injector which may compensate decrease in the amount of fuel flow because of decrease in the specific weight of fuel and creation of fuel vapor at the fuel injection nozzle in association with increase in fuel temperature.

It is another object of the present invention to provide an electromagnetic fuel injector which may supply an engine with fuel mixture having stable air-fuel ratio to purify exhaust gas during engine operation at high temperatures.

According to the present invention, in combination with an electromagnetic fuel injector for an internal combustion engine including a valve housing provided with a fuel injection nozzle and a valve seat at its front end and guide hole extending along the axis of the valve housing, a valve body slidably inserted into the guide hole, which valve body is comprised of a cylindrical slide member having a fuel passage therein and a substantially spherical valve member fixed on the tip of the slide member, a compression spring adapted to normally urge the valve body so as to close the fuel injection nozzle, an armature fixed to the rear end of the valve body, a fixed magnet core having a front end opposite to the rear end of the armature and having a fuel passage extending through its central portion, an exciting coil surrounding the fixed magnet core and an electromagnetic housing combining the valve housing with the fixed magnet core, wherein the electromagnetic fuel injector is adapted to discharge pressurized fuel when the exciting coil receives control signal to open the valve body, the improvement comprises a fuel outlet opening formed at the front portion of the slide member, an annular fuel passage leading from the fuel outlet opening to the valve seat and an annular restricted portion provided at the annular fuel passage.

In a modified arrangement of the present invention, the annular restricted portion is gradually spreaded toward the valve seat. In other words, the cross-sectional area of the annular restricted portion is increased in the downstream direction. With this arrangement, the rate of recovery of fuel pressure at the outlet of the restricted portion may be increased and turbulence of fuel flow may be minimized, thereby effectively preventing creation of fuel vapor at the inlet of the fuel injection nozzle.

In a further modified arrangement of the present invention, the valve seat is formed into a conical surface, and the valve member includes a seal portion abutted against the conical valve seat in the valve closing position and a conical portion provided on the downstream side of the seal portion. In the valve opening position, the annular space defined between the conical valve seat and the conical portion of the valve member to form a restricted portion. Since the restricted portion is formed on the downstream side of the seal portion of the valve body, creation of fuel vapor in the vicinity of the fuel injection nozzle may be suppressed and fuel dribbling after closing the valve may be reduced, thereby improving control characteristics of the amount of injected fuel flow.

The invention will be more fully understood from the following detailed description and appended claims when taken with the drawings.

DETAILED DESCRIPTION OF THE PREFERRED EMBODIMENTS

Figure 1:
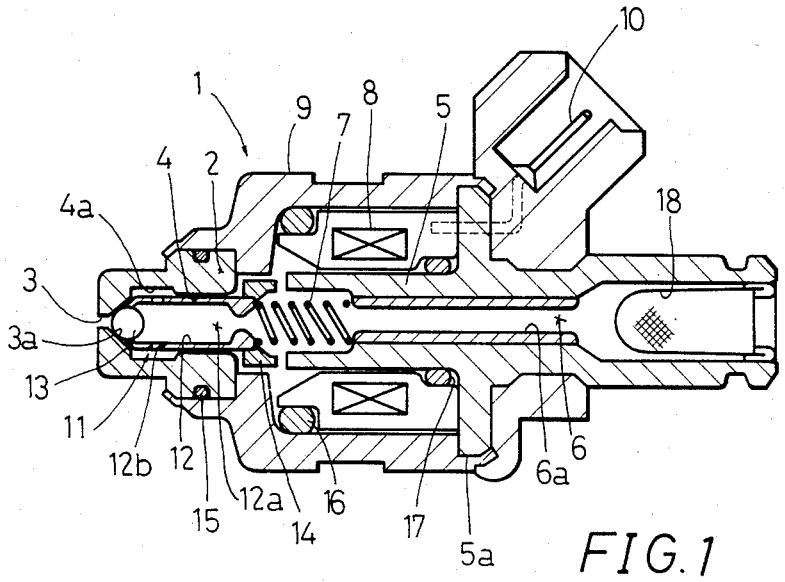
FIG. 1 is a vertical sectional view of the electromagnetic fuel injector of the first embodiment according to the present invention.

Referring now to FIG. 1 which generally shows an electromagnetic fuel injector 1 of the first embodiment, reference numeral 2 designates a substantially cylindrical valve housing having a fuel injection nozzle 3 at the center of its extreme end. The valve housing 2 is provided with a guide hole 4 axially extending therein and communicating with the fuel injection nozzle 3. A conical valve seat 3*a* and a fuel well 4*a* are formed between the fuel injection nozzle 3 and the guide hole 4. A valve body 11 is of a plunger type and includes a cylindrical slide member 12 slidably inserted in the guide hole 4. A substantially spherical valve member 13 is fixed to the front end of the slide member 12, and an armature 14 having a central opening is attached on the outer circumference of the rear end of the slide member 12. A fuel passage 12*a* is formed in the slide member 12, and a fuel outlet opening 12*b* is opened through the cylindrical wall of the front portion of the slide member 12 and is communicated with the fuel well 4*a*. A fixed magnet core 5 is of substantially cylindrical shape and is provided with a flange 5*a* on the outer circumference of the longitudinally central portion thereof. The front end of the core 5 is opposed to the rear end of the armature 14. A fuel passage 6 is axially extended in the core 5. A sleeve 6*a* is fitted in the fuel passage 6 and a compression spring 7 is inserted between the front end of the sleeve 6*a* and the rear end of the slide member 12 so as to forwardly bias the valve body 11 and normally close the same. The front half portion of the fixed magnet core 5 is surrounded by an exciting coil 8 which in turn is covered with a substantially cylindrical electromagnetic housing 9. The front end of the electromagnetic housing 9 is fixed to the rear portion of the valve housing 2 and the rear end of the electromagnetic housing 9 is fixed to the flange 5*a* of the fixed magnet core 5. An input terminal 10 of the exciting coil 8 is provided on the rear side of the flange 5*a*. Reference numerals 15, 16 and 17 designate O-ring seals, and reference numeral 18 designates a fuel filter.

Figure 2A:
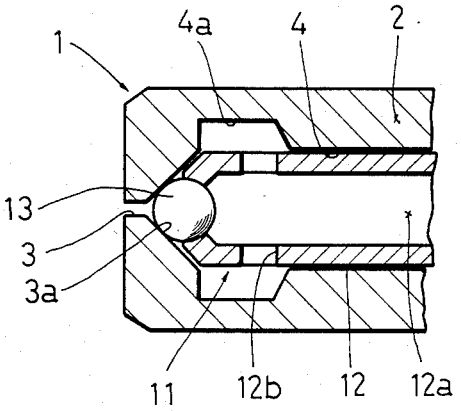
FIGS. 2A and 2B are enlarged vertical sectional views of the essential part in FIG. 1.
Figure 2B:
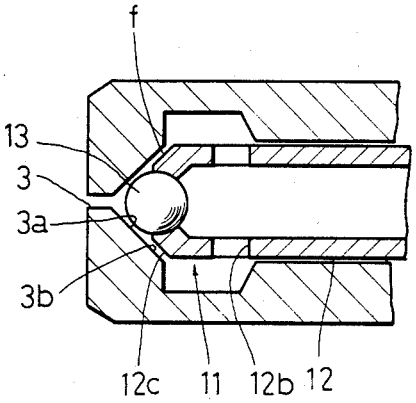

As shown in FIGS. 2A and 2B illustrating the front half portion of the valve housing 2 of the electromagnetic fuel injector 1, when the valve body 11 advances to abut against the valve seat 3*a*, the fuel injection nozzle 3 is closed. (See FIG. 2A.) The front end of the slide member 12 is formed with a conical surface 12*c* which is parallel to the conical surface 3*b* of the valve seat 3*a*. When the valve body 11 is opened, the parallel conical surfaces 3*b* and 12*c* form an annular restricted portion f on the fuel passage between the fuel outlet opening 12*b* and the fuel injection nozzle 3. The vertical cross-sectional lengths of the conical surfaces 3*b* and 12*c* are determined in such a manner that the compensation of the fuel flow due to the viscosity of the fuel passing through the restricted portion f becomes optimal.

Figure 3A:
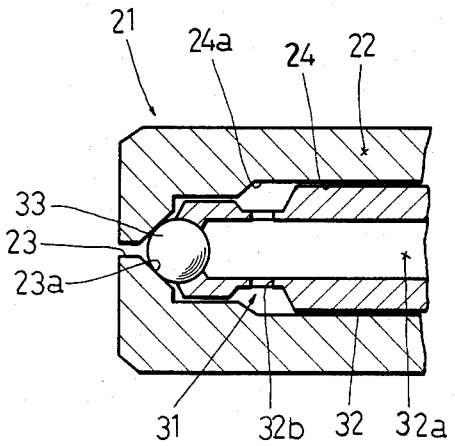
FIGS. 3A and 3B are enlarged vertical sectional views of the essential part of the second embodiment.
Figure 3B:
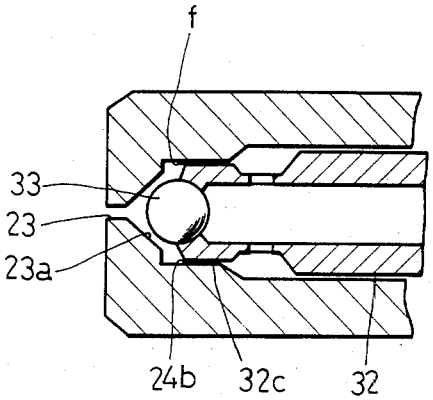

Referring next to FIGS. 3A and 3B, which show a second embodiment, the front portion of the guide hole 24 of the valve housing 22 is formed with a cylindrical surface 24*b* having a smaller diameter than the guide hole 24 and being aligned with the guide hole 24. The opposite surface of the slide member 32 to the cylindrical surface 24*b* forms a cylindrical surface 32*c* parallel to the cylindrical surface 24*b*, thereby defining an annular restricted portion f between both the cylindrical surfaces 24*b* and 32*c*. In this embodiment, the vertical cross-sectional length of the restricted portion f may be more flexibly determined and the clearance of the restricted portion f is hardly affected by the stroke of the valve body 31, thereby achieving a constant compensation effect of the fuel flow.

With this arrangement, the amount of the fuel fed from the fuel well 4*a* to the fuel injection nozzle 3 is influenced by viscosity of the fuel during passing through the restricted portion f. In general, when the temperature of the fuel increases, the coefficient of the fuel viscosity decreases, resulting in increase in the amount of fuel flow, and on the other hand, the specific weight of the fuel decreases, resulting in decrease in the amount of the fuel flow. This relationship may be represented by the following equation, provided that it is approximated by the flow in parallel double pipes.

$$G_f \approx CA\sqrt{2gr_f(P-\Delta P)} \quad (1)$$

$$\Delta P \approx 48\mu V \cdot l/De^2 \quad (2)$$

$$De = D - d$$

wherein,

- $G_f$: amount of fuel flow
- C: coefficient of fuel flow downstream of the restricted portion
- A: cross-sectional area of fuel passage downstream of the restricted portion
- $r_f$: specific weight of fuel
- P: pressure of fuel
- $\Delta P$: friction loss at the restricted portion
- $\mu$: coefficient of fuel viscosity
- V: fuel velocity at the restricted portion
- l: length of the restricted portion
- D: inside diameter of the valve housing at the restricted portion
- d: outside diameter of the valve body at the restricted portion As will be apparent from the equation (2), when the temperature of the fuel increases, the coefficient of viscosity $\mu$ decreases and accordingly the friction loss $\Delta P$ also decreases. As a result, the amount of fuel flow $G_f$ increases with decrease in the coefficient of viscosity according to the equation (1). On the other hand, as the specific weight $r_f$ decreases with increase in the temperature of the fuel, the amount of fuel flow $G_f$ decreases according to the equation (1). Consequently, change in the amount of fuel flow due to change in temperature of fuel may be reduced by setting the friction loss $\Delta P$ at the restricted portion to a suitable value.

Figure 5:
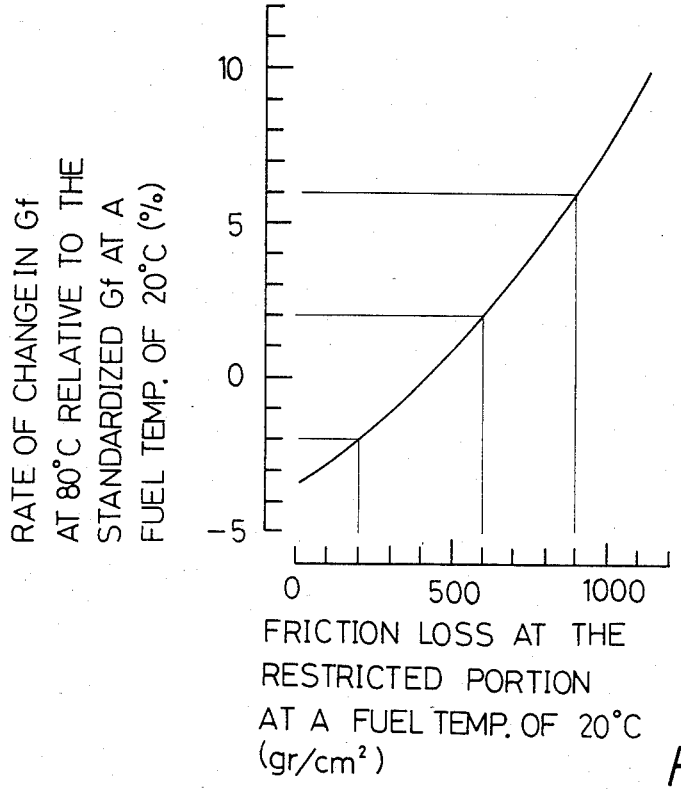
Figure 6:
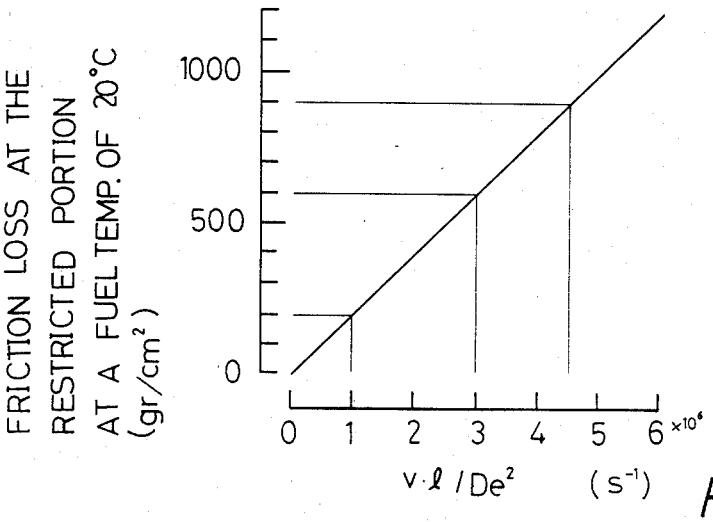

In FIG. 5 illustrating a rate of change in the amount of fuel flow relative to the friction loss at the restricted portion, the rate of change in the amount of fuel flow is shown in the case that the fuel temperature increases from 20° C. to 80° C. and the fuel pressure is 2550 gr/cm$^2$. When the rate of change in the amount of fuel flow is required to be within $\pm 2\%$ for example, the friction loss $\Delta P$ may be suitably set to 200 gr/cm$^2$ to 600 gr/cm$^2$. In case of decrease in the amount of fuel flow due to creation of fuel vapor at the fuel injection nozzle, the friction loss $\Delta P$ at the retricted portion may be set to an increased value, for example to about 900 gr/cm$^2$. To obtain a specifically required friction loss $\Delta P$, the value of $V \cdot l/De^2$ may be suitably set to $1 \times 10^6$ ($s^{-1}$) to $4.5 \times 10^6$ ($s^{-1}$) as shown in FIG. 6.

The velocity of fuel flow passing through the restricted portion f is set to a laminar zone in order that the amount of fuel flow may be readily influenced by the viscosity of fuel and that the restriction loss due to change in the velocity may become small. In the first embodiment as shown in FIGS. 2A and 2B, the stroke of the valve body 11 is set to a suitable range as the clearance of the restricted portion f becomes large (the value of De in the equation (2) becomes large) and the effect of the viscosity is reduced if the stroke of the valve body 11 is large.

Figure 4:
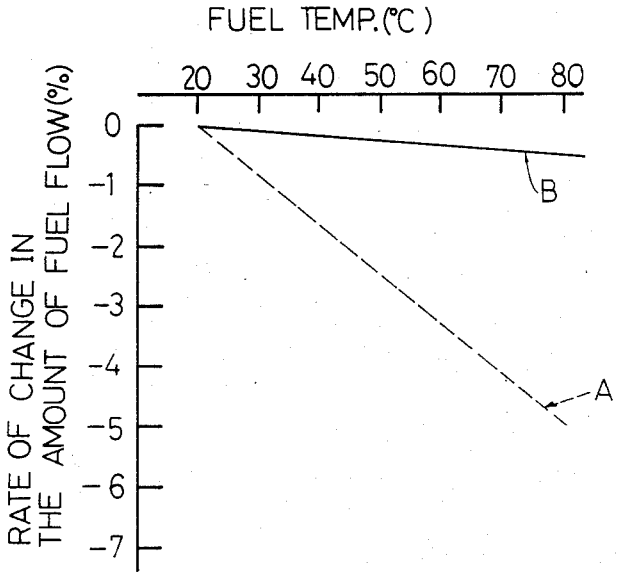
FIGS. 4 to 6 are graphical representations showing the operation of the first and second embodiments.

As is above-described, the restricted portion f serves to compensate the decrease in the specific weight $r_f$ due to the increase in the fuel temperature and the decrease in the amount of fuel flow due to the creation of fuel vapor, thereby minimizing the rate of change in the amount of fuel flow as shown by the solid line B in FIG. 4. If any required friction loss ought to be obtained without using the constitution of this invention, the stroke of the valve body requires to be reduced or the diameter of the spherical valve member to be greatly increased. In the former case, the pressure loss at the valve seat will become so large as to cause creation of fuel vapor and in the latter case, weight of the valve body will be increased to adversely affect the responsiability of the valve body. According to this invention, since various elements of the restricted portion may be arbitrarily determined, the rate of change in the amount of fuel flow may be maintained at a minimum level without affecting fuel injecting characteristics.

Figure 7:
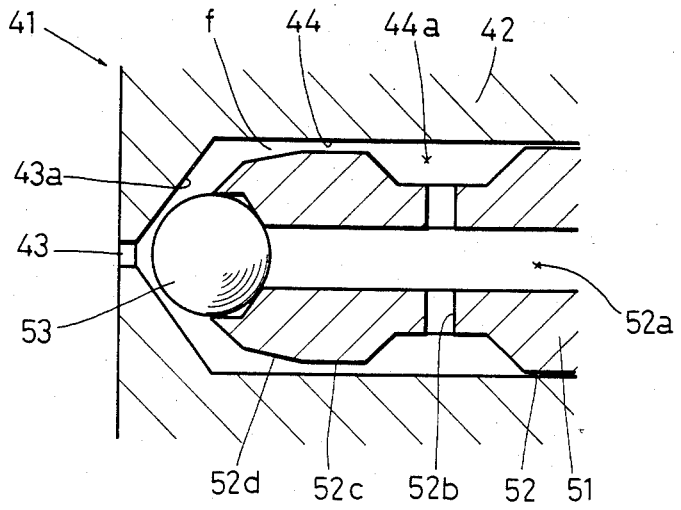
FIGS. 7 and 8 are enlarged vertical sectional views of the essential part of the third and fourth embodiments, respectively.

Referring next to FIG. 7 which shows a third embodiment of the invention, reference numeral 41 is an electromagnetic fuel injector including a valve housing 42, a fuel injection nozzle 43, a valve seat 43*a* and a guide hole 44. A valve body 51 is composed of a cylindrical slide member 52 slidably inserted into the guide hole 44 and a substantially spherical valve member 53 fixed to the front end of the slide member 52. A fuel passage 52*a* is formed in the slide member 52 and is communicated through a fuel outlet opening 52*b* with a fuel well 44*a*. The slide member 52 is formed with a cylindrical portion 52*c* and a partially conical portion 52*d* at the fore part of the fuel outlet opening 52*b* to define an annular restricted portion f between the cylindrical portion 52*c*, the partially conical portion 52*d* and the inner surface of the guide hole 44. The cross-sectional area of the restricted portion f is increased toward the downstream portion owing to the partially conical portion 52*d*.

The amount of fuel flow passing through the restricted portion f according to the third embodiment is represented by the approximation with the following equation, modifying the equations (1) to (3) in the previous embodiment.

$$G_f \approx CA\sqrt{2gr_f(P-\Delta P_1-\Delta P_2)} \quad (4)$$

$$\Delta P_1 \approx 48 v_m l/De^2 \quad (5)$$

$$\Delta P_2 \approx \zeta r_f v_0^2/2g \quad (6)$$

Wherein, $\Delta P_1$: friction loss at the restricted portion $\Delta P_2$: restriction loss $v_m$: mean flow velocity of fuel at the restricted portion De: central value of the clearance of the restricted portion $\zeta$: coefficient of loss $v_0$: velocity of fuel flow at the outlet of the restricted portion Other elements are identical with those in the equations (1) and (2). As should be appreciated from the equations (4), (5) and (6), when the fuel temperature is increased, the specific weight of fuel $r_f$ and the coefficient of viscosity $\mu$ are decreased. However, change in the value of $r_f(P-\Delta P_1-\Delta P_2)$ may be maintained at a minimum value by suitably determining the values of l and De and suppressing change in the value of $(P-\Delta P_1-\Delta P_2)$ due to change in the fuel temperature. In other words, changes in the specific weight of fuel and in the coefficient of viscosity are compensated and thereby fluctuation in the amount of fuel flow $G_f$ due to change in the fuel temperature may be suppressed. As is above-described, $\Delta P_2$ represents a loss of pressure at the outlet of the restricted portion f and $\zeta$ is a coefficient of the loss. When the maximum value of the coefficient of loss $\zeta$ is 1, the rate of recovering a velocity energy from a pressure energy is 0. In the case that a fuel passage is rapidly expanded, $\zeta$ approaches 1. However, since the partially conical portion 52*d* is formed at the restricted portion f, the cross-sectional area of the restricted portion f is gradually increased. As a result, the recovery rate of pressure is improved as is similar to a usual venturi, thereby reducing the restriction loss $\Delta P_2$. According to this embodiment, it is confirmed by the equations (4), (5) and (6) that the recovered pressure reaches 200 gr/cm$^2$ at a maximum.

Figure 9:
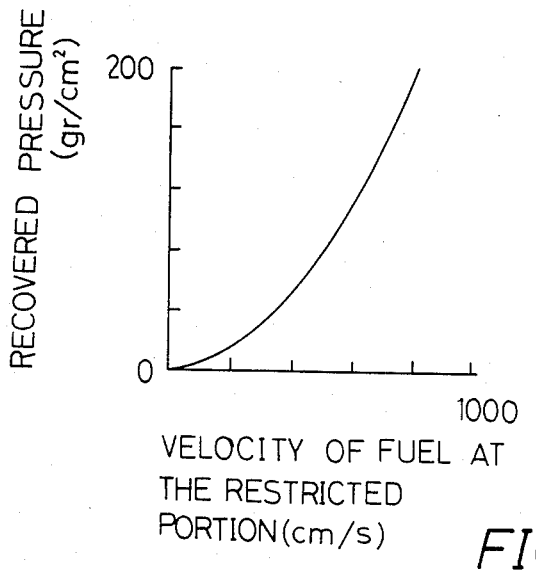
FIGS. 9 and 10 are graphical representations showing the operation of the third and fourth embodiments.
Figure 10:
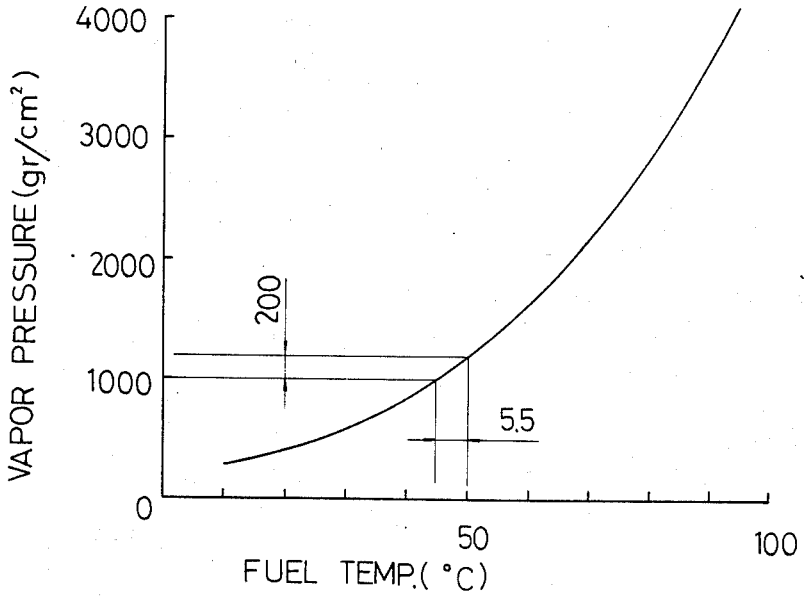

FIG. 9 shows a relation between the velocity of fuel flow at the restricted portion and the pressure recovered at the outlet of the restricted portion. If $\zeta_1=1$, $\zeta_0=0.2$ and $r_f=0.745$ gr/cm$^3$, the following equation may be obtained:

$$\Delta P_2=(\zeta_0-\zeta_1)r_f v_0^2/2g=-3.04\times10^{-4}\times v_0^2$$

wherein $\zeta_1$ is the coefficient of loss of pressure at the fuel passage rapidly expanding and $\zeta_0$ is the coefficient of loss of pressure at the fuel passage gradually expanding. As is apparent from FIG. 9, when $v_0$ is 800 cm/s, $\Delta P_2$ is approximately $-200$ gr/cm$^2$. As shown in FIG. 10 illustrating a vapor pressure curve of gasoline, pressure differential of 200 gr/cm$^2$ corresponds to the difference of fuel temperature of about 5° C. The pressure at the inlet of the fuel injection nozzle 43 is increased to the extent that the restriction loss $\Delta P_2$ is decreased, thereby contributing to prevention of creation of fuel vapor. Moreover, according to this embodiment, since the velocity $v_0$ at the outlet of the restricted portion f is small, turbulence of fuel flow may be reduced, thereby also contributing to prevention of creation of fuel vapor. Consequently, the electromagnetic fuel injector according to the invention may ensure the fixed amount of fuel flow even at high temperatures.

Figure 8:
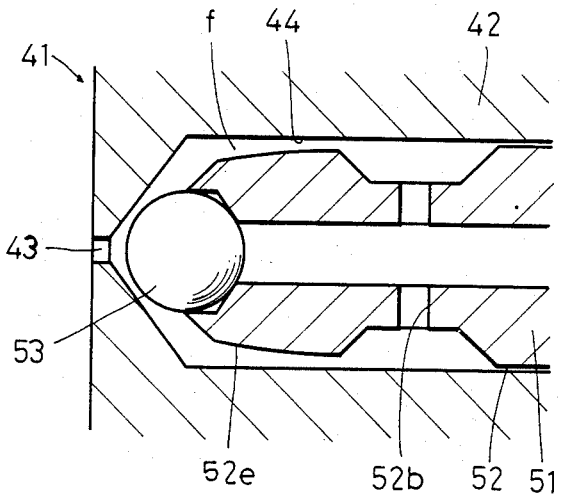

Referring to FIG. 8 which shows a fourth embodiment, the slide member 52 of the valve body 51 is formed with a partially ellipsoidal portion 52*e* at the fore portion of the fuel outlet opening 52*b* to define an annular restricted portion f between the guide hole 44 and the partially ellipsoidal portion 52*e*. The cross-sectional area of the restricted portion f is enlarged toward the downstream portion thereof. The operation of this embodiment is identical with that of the third embodiment.

Figure 11A:
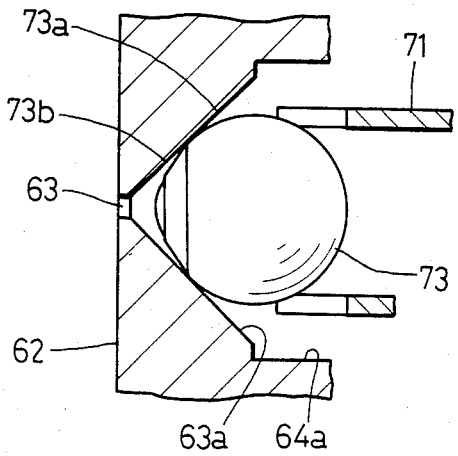
FIGS. 11A, 11B and 12 are enlarged vertical sectional views of the essential part of the fifth and sixth embodiments.
Figure 11B:
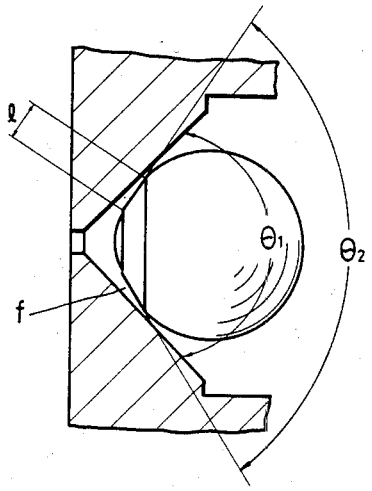

Referring to FIGS. 11A and 11B which show a fifth embodiment, a valve member 73 of the valve body 71 is formed integrally with a partially conical portion 73*b* at its front portion. The conical portion 73*b* is coaxial with the valve body 71 and has a vertical angle $\theta_2$ larger than the vertical angle $\theta_1$ of the conical valve seat 63*a*. In the valve closing position (FIG. 11A), the circumference of the rear end of the conical portion 73*b* is abutted against the valve seat 63*a* to provide a seal portion 73*a*. In the valve opening position (FIG. 11B), the conical portion 73*b* having a length l and the valve seat 63*a* provide an annular space having the length l to form a restricted portion f of the fuel passage.

The amount of fuel flow passing through the restricted portion f is approximated with the equations (1) to (3) in the first embodiment. Accordingly, change in the value of $r_f(P-\Delta P)$ may be maintained at a minimum value by suitably determining the values of l and De and suppressing change in the value of $(P-\Delta P)$ due to change in fuel temperatures. In other words, change in the specific weight of fuel and change in the coefficient of viscosity are compensated to reduce fluctuation in the amount of fuel flow $G_f$ at the restricted portion f due to change in fuel temperature. A conventional valve structure without the restricted portion corresponds to the case that l is approximated to zero and De is larger, wherein $\Delta P$ is also approximated to zero in the equation (2). Accordingly, the equation (1) is modified by the following equation (1)':

$$G_f \approx CA\sqrt{2gr_f P} \quad (1)'$$

As is apparent from the equation (1)', the amount of fuel flow $G_f$ is greatly decreased by the influence of decrease in the specific weight $r_f$ of fuel due to increase in fuel temperature.

Figure 13:
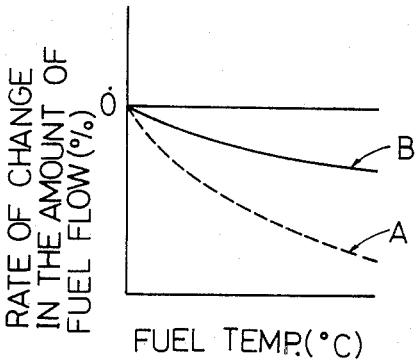
FIG. 13 is a graphical representation showing the operation of the fifth and sixth embodiment.

In FIG. 13 showing a relation between the rate of change in the mass amount of injected fuel flow and the fuel temperature according to this embodiment in comparison with the prior art. In the prior art as depicted by the dotted line A, the amount of injected fuel flow is greatly decreased with increase in the fuel temperature. On the contrary, in this embodiment as depicted by the solid line B, the rate of decrease in the amount of injected fuel flow is relatively small, which results from the effect of the restricted portion f of the invention.

Figure 12:
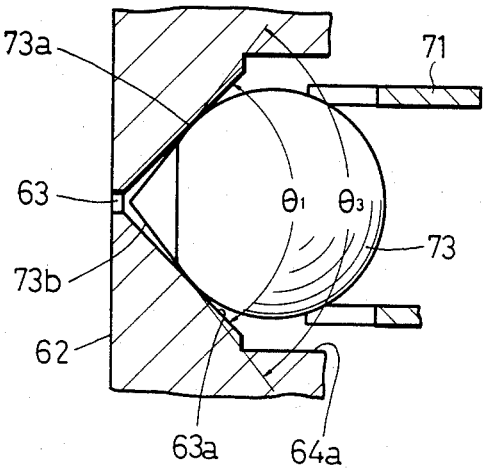

Referring to FIG. 12 which shows a sixth embodiment, a cone member 73*b* for forming the restricted portion is attached to the valve member 73 on the fore side of the seal portion 73*a* adapted to be abutted against the valve seat 63*a*. The cone member 73*b* has a vertical angle $\theta_3$ larger than the vertical angle $\theta_1$ of the conical valve seat 63*a* and is coaxial with the valve body 71. Other constitution is identical with that in the fifth embodiment.

In a valve opening position, since the restricted portion f is defined between the conical valve seat 63*a* and the cone member 73*b*, the effect of the restricted portion as is obtained in the fifth embodiment may be achieved. Furthermore, in the valve closing position, the seal portion 73*a* of the valve member 73 abutted against the conical valve seat 63*a* is a part of the spherical surface of the valve member 73, thereby ensuring a self-alignment function of the valve body and in association therewith rendering the valve body lightweight and easy to manufacture. In this embodiment, the cone member 73*b* is formed independently of the valve member 73, and as a result, the length l and the clearance De of the restricted portion may be more flexibly determined and the rate of decrease in the amount of injected fuel flow may be rendered smaller.

In the fifth and sixth embodiments, since the restricted portion is provided on the downstream side of the seal portion 73*a* of the valve member 73, the spaced defined between the seal portion 73*a* and the fuel injection nozzle 63 becomes smaller, thereby suppressing creation of fuel vapor in the vicinity of the fuel injection nozzle 63 and improving fuel dribbling after closing the valve.

While the invention has been shown and described in its preferred embodiments, it will be clear to those skilled in the arts to which it pertains that many changes and modifications may be made thereto without departing from the scope of the invention.

What is claimed is:

1. In combination with an electromagnetic fuel injector for an internal combustion engine including a valve housing provided with a fuel injection nozzle and a valve seat at its front end and a guide hole extending along the axis of said valve housing, a valve body slidably inserted into said guide hole, said valve body being composed of a cylindrical slide member having a fuel passage therein and a substantially spherical valve member fixed on the tip of said slide member, a compression spring adapted to normally urge said valve body so as to close said fuel injection nozzle, an armature fixed to the rear end of said valve body, a fixed magnet core having a front end opposite to the rear end of said armature and having a fuel passage extending through its central portion, an exciting coil surrounding said fixed magnet core and an electromagnetic housing combining said valve housing with said fixed magnet core, wherein said electromagnetic fuel injector is adapted to discharge pressurized fuel when said exciting coil receives control signal to open said valve body, the improvement comprising a fuel outlet opening formed at the front portion of said slide member, an annular fuel passage leading from said fuel outlet opening to said valve seat and an annular restricted portion provided along a definite length of said annular fuel passage.

2. The electromagnetic fuel injector as defined in claim 1, wherein said annular restricted portion is defined between a first conical surface formed at the front end of said slide member and a second conical surface formed at the front end of said guide hole, said second conical surface being in parallel relation with said first conical surface.

3. The electromagnetic fuel injector as defined in claim 1, wherein said annular restricted portion is defined between a first cylindrical surface formed at the front portion of said guide hole and a second cylindrical surface formed at the front portion of said slide member in opposed relation with said first cylindrical surface, said first cylindrical surface being coaxial with said guide hole and having a smaller diameter than the inner diameter of said guide hole.

* * * * *